United States Patent [19]

Neff

[11] Patent Number: 4,485,846

[45] Date of Patent: Dec. 4, 1984

[54] FOUR-WAY VALVE WITH INTEGRAL FLOW CONTROLS, COMMON EXHAUST, AND CARTRIDGE TYPE PILOT VALVE

[75] Inventor: James A. Neff, Bloomfield Township, Oakland County, Mich.

[73] Assignee: Mac Valves, Inc., Wixom, Mich.

[21] Appl. No.: 352,023

[22] Filed: Feb. 24, 1982

[51] Int. Cl.[3] ..... F15B 13/043

[52] U.S. Cl. ..... 137/625.64; 91/459; 137/454.2; 137/884; 137/625.66; 251/30

[58] Field of Search ..... 137/454.2, 625.64, 884, 137/625.66; 91/459; 251/30

[56] References Cited

U.S. PATENT DOCUMENTS

| | | | |
|---|---|---|---|
| 2,761,470 | 9/1956 | Batts | 137/625.6 |
| 2,993,511 | 7/1961 | Johnson | 137/625.64 |
| 3,238,972 | 3/1966 | Bowman | 137/625.64 |
| 3,385,166 | 5/1968 | Kroffke | 137/625.6 X |
| 3,513,876 | 5/1970 | Tarbox | 137/884 X |
| 4,267,862 | 5/1981 | Neff et al. | 137/625.64 |

*Primary Examiner*—Gerald A. Michalsky
*Attorney, Agent, or Firm*—Robert G. Mentag

[57] ABSTRACT

A four way, pilot air operated air valve provided with flow control valves in individual exhaust passages in the valve body of the valve. The exhaust flow control valves are mounted in the valve cover. The pair of exhaust passages are connected to a common exhaust passageway which is connected to a single exhaust port in the valve body. The four-way air valve includes a cartridge type pilot air valve. The pilot air for the pilot air valve can be supplied either internally or externally. The pilot air valve is operated by a suitable solenoid.

10 Claims, 17 Drawing Figures

FOUR-WAY VALVE WITH INTEGRAL FLOW CONTROLS, COMMON EXHAUST, AND CARTRIDGE TYPE PILOT VALVE

TECHNICAL FIELD

This invention relates generally to the air valve art, and more particularly to an improved four-way, pilot air operated valve with individual exhaust flow control valves. The pilot air is controlled by a cartridge type pilot valve which is operated by a solenoid, and the pilot air can be supplied either internally or externally. The valve of the present invention is adapted for use in an air flow line for controlling the flow of pressurized air to both ends of an air cylinder, or the like.

BACKGROUND ART

It is known in the air valve art to provide valves which include flow control valves in the exhaust flow system. Examples of the use of flow control valves in exhaust flow systems of complicated valve structures are shown in U.S. Pat. Nos. 2,912,007 and 2,993,511. Heretofore, it has not been possible to provide a four-way, air valve with flow exhaust control valves to control individually the exhaust from each end of an air operated apparatus to be controlled, such as an air cylinder or the like, and yet have both exhaust flow control valves exhaust from the valve through a common exhaust port. It has also not been possible heretofore to provide the aforementioned four-way air valve with a cartridge type pilot air valve controlling the operation of the main spool of the four-way air valve.

DISCLOSURE OF THE INVENTION

In accordance with the present invention, the four-way, pilot air operated air valve is provided with flow control valves in individual exhaust passages in the valve body of the valve, and with exhaust flow control valves being mounted in the cover of the valve and operative to control the flow through the individual exhaust passages. The pair of exhaust passages are connected to a common exhaust passage which is connected to a single exhaust port in the valve body. The four-way air valve is a pilot air operated valve which includes a cartridge type pilot air valve. The pilot air for the pilot air valve can be supplied either internally or externally. The pilot air valve is operated by a suitable solenoid.

BEST MODE OF CARRYING OUT THE INVENTION

Figure 1:
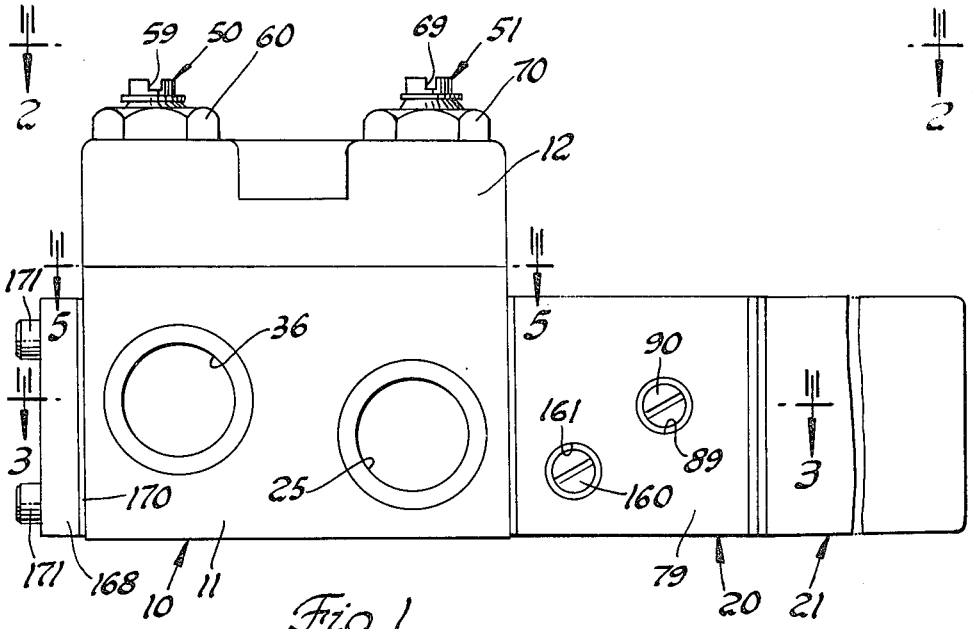
FIG. 1 is a side elevation view of a four-way flow control valve made in accordance with the principles of the present invention.
Figure 2:
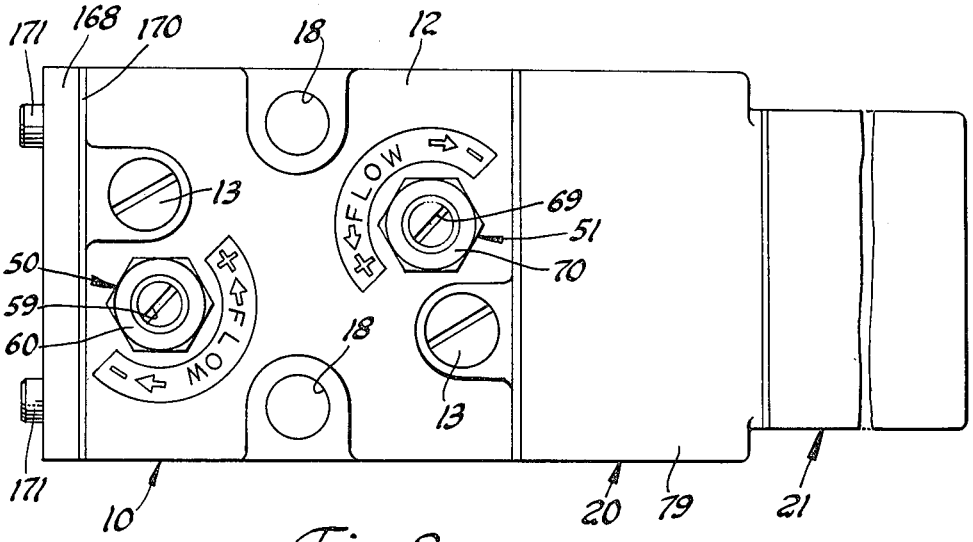
FIG. 2 is a top plan view of the valve structure illustrated in FIG. 1, taken along the line 2—2 thereof, and looking in the direction of the arrows.
Figure 3:
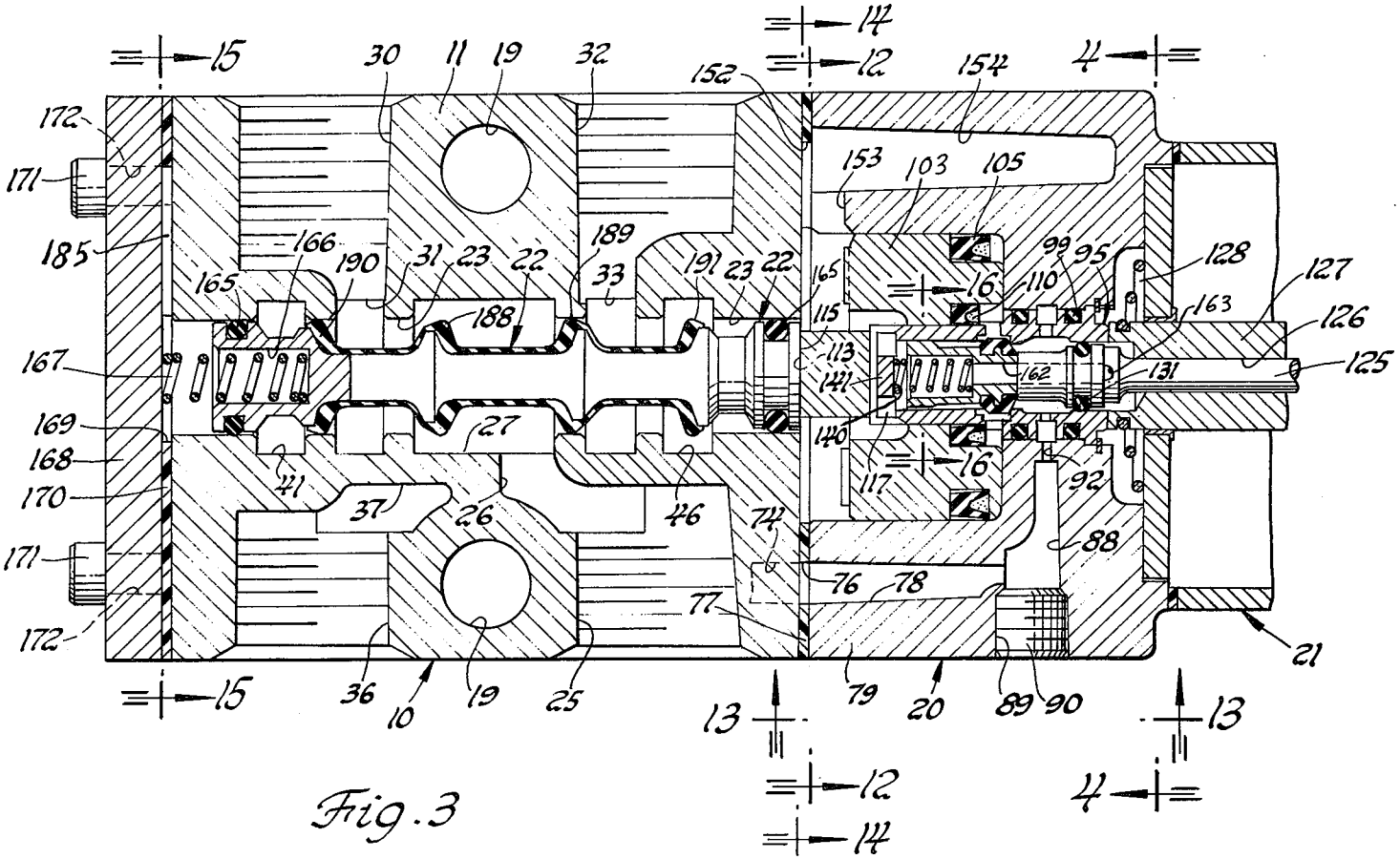
FIG. 3 is a fragmentary, enlarged, longitudinal section view of the valve structure illustrated in FIG. 1, taken along the line 3—3 thereof, and looking in the direction of the arrows.
Figure 8:
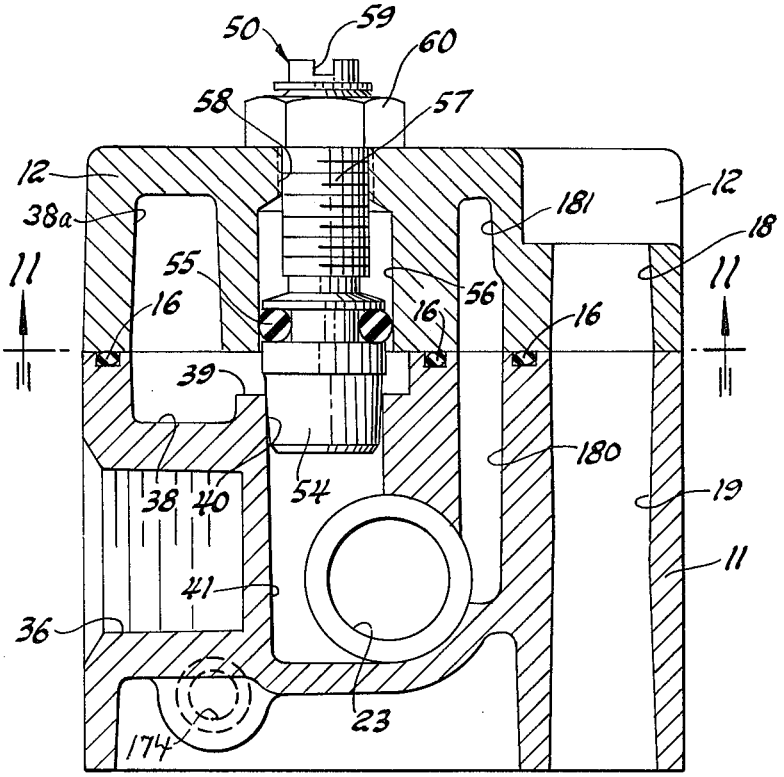
FIG. 8 is an elevation section view of the valve body structure illustrated in FIG. 5, taken along the line 8—8 thereof, and looking in the direction of the arrows, and showing the valve body cover mounted on the valve body.
Figure 10:
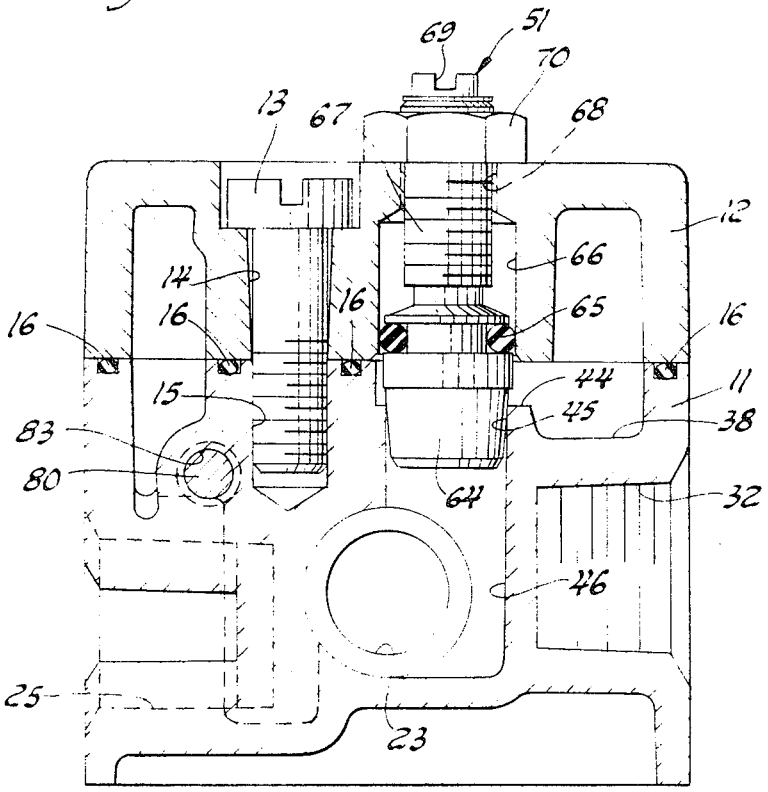
FIG. 10 is an elevation section view of the valve body structure illustrated in FIG. 5, taken along the line 10—10 thereof, looking in the direction of the arrows, and showing the valve body cover mounted on the valve body.
Figure 11:
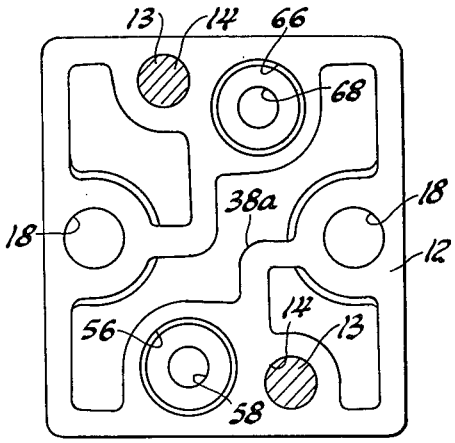
FIG. 11 is a bottom plan view of the valve body cover illustrated in FIG. 8, taken along the line 11—11 thereof, and looking in the direction of the arrows.

Referring now to the drawings, and in particular to FIGS. 1 and 2, the numeral 10 generally designates a four-way air valve made in accordance with the principles of the present invention. The valve 10 includes a valve body 11 which is provided on the top side thereof with a top cover 12 that is releasably secured in position by suitable machine screws 13 (FIG. 10), each of which extend down through a suitable bore 14 in the cover 12, and down into threaded engagement with a threaded bore 15 in the valve body 11. As shown in FIG. 10, suitable seal members 16 are operatively mounted between the cover 12 and the valve body 11. As shown in FIGS. 2, 3 and 8, the cover 12 and valve body 11 are provided with a pair of aligned bores 18 and 19, respectively, for operatively mounting the valve 10 in place in a desired operative position.

As shown in FIGS. 1 and 2, the numeral 20 generally designates a cartridge type pilot valve, and the numeral 21 generally designates a conventional solenoid for operating the pilot valve 20. As shown in FIG. 3, the numeral 22 generally designates the main valve spool which is operatively mounted in the longitudinal main valve spool bore 23. The valve spool bore 23 extends through the valve body 11.

As shown in FIG. 3, the valve body 11 is provided on one side thereof with an inlet port 25 which would be connected to a suitable source of air under pressure. The inlet port 25 is connected by a passage 26 to an annular chamber 27 formed centrally along the main valve spool bore 23. As shown in FIG. 3, the valve body 11 is provided with a first cylinder or work port 30 that is connected to an annular chamber 31 in the valve spool bore 23. The valve body 11 includes a second cylinder or work port 32 which is connected to an annular chamber 33 formed in the valve spool bore 23. As shown in FIG. 3 the valve body 11 is provided with an exhaust port 36 which is connected by a passage 37 to a transverse exhaust passage 38, as shown in FIGS. 3 and 5.

Figure 5:
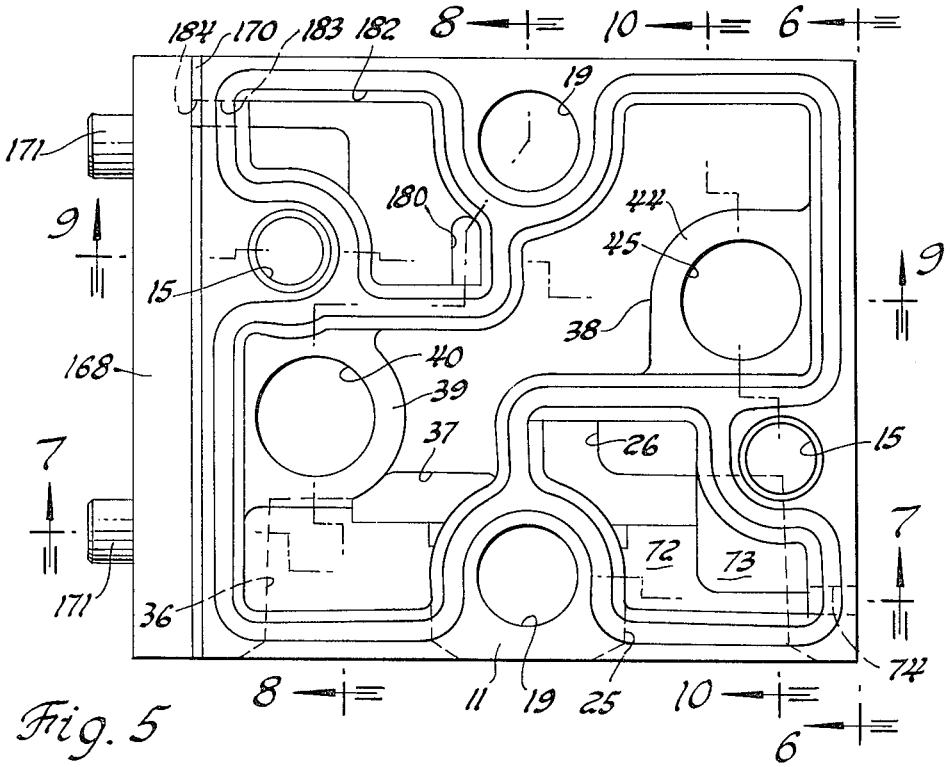
FIG. 5 is a horizontal view of the valve body structure illustrated in FIG. 1, taken along the line 5—5 thereof, and looking in the direction of the arrows.
Figure 9:
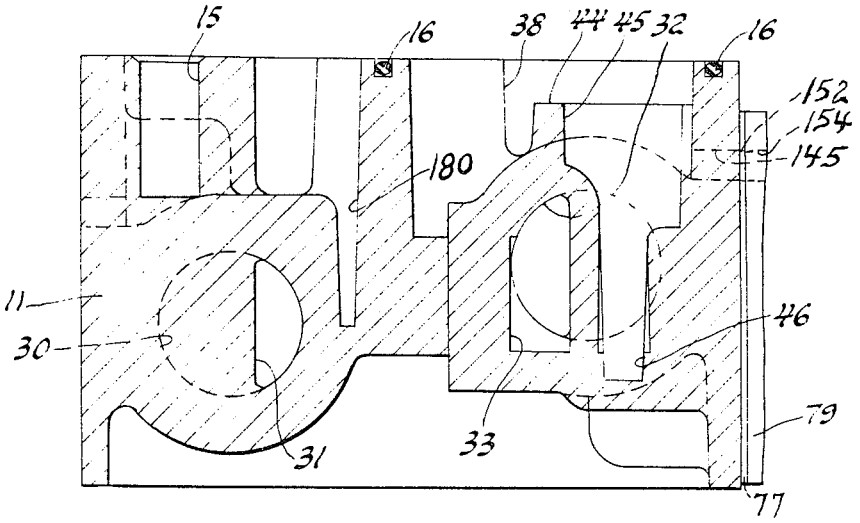
FIG. 9 is an elevation section view of the valve body structure illustrated in FIG. 5, taken along the line 9—9 thereof, and looking in the direction of the arrows.

The exhaust passage 38 is connected by a communicating horizontal passage 39 to the upper end of a cylindrical flow control exhaust bore 40 (FIG. 5). As shown in FIG. 8, the bore 40 communicates with an exhaust chamber 41 (FIG. 3), in the valve spool bore 23. As shown in FIG. 8, the upper end of the exhaust passage 38 communicates with a similarly shaped passage 38*a* in the cover 12. As shown in FIGS. 5, 9 and 10, the exhaust passage 38 communicates with a second inwardly extended passage 44 which has a lower flat surface that is disposed at the upper end of a flow control exhaust bore 45. The exhaust bore 45 communicates with an exhaust chamber 46 formed in the valve spool bore 23.

As shown in FIGS. 1 and 2, the valve 10 is provided with a pair of exhaust flow control valves, generally indicated by the numerals 50 and 51. As shown in FIG. 8, the exhaust flow control valve 50 includes a flow control valve element 54 which is provided with a conically shaped outer periphery. The flow control valve element 54 is integrally carried by a threaded valve stem 57 which has a suitable O-ring seal 55 mounted around the inner end thereof adjacent the flow control valve element 54. The valve stem 57 and the O-ring seal 55 are movably mounted in a bore 56 in the cover 12. The bore 56 is aligned with the bore 40 in the valve body 11. The reduced diameter threaded outer end of the bore 56 is indicated by the numeral 58, and the valve stem 57 has its outer end threadedly mounted through the threaded bore 58. The position of the flow control valve element 54 is adjusted relative to the upper end of the bore 40, for controlling the flow of exhaust air from the bore 40 into the passages 39 and 38, by adjusting the valve stem 57 outwardly or inwardly, as desired, by means of a suitable tool inserted into a cross slot 59 formed in the outer end of the valve stem 57. The valve stem 57 is locked in a desired adjusted position by means of a suitable lock nut 60. It will be seen that the flow of exhaust air from the exhaust chamber 41, and up through the bore 40 into the passages 39, 38 and 37, and out the exhaust port 36 may be controlled by controlling the position of the flow control valve element 54, relative to the upper end of the bore 40.

The exhaust flow control valve 51 is constructed identically to the exhaust flow control valve 50, and the details thereof are shown in FIG. 10. The exhaust flow control valve 51 includes a flow control valve element 64 which is provided with a conically shaped outer periphery. The flow control valve element 64 is integrally carried by a threaded valve stem 67, which has a suitable O-ring seal 65 mounted around the inner end thereof adjacent the flow control valve element 64. The valve stem 67 and the O-ring seal 65 are movably mounted in a bore 66 in the cover 12. The bore 66 is aligned with the bore 45 in the valve body 11. The reduced diameter, threaded outer end of the bore 66 is indicated by the numeral 68, and the valve stem 67 has its outer end threadably mounted through the threaded bore 68. The position of the flow control valve element 64 is adjusted relative to the upper end of the bore 45, for controlling the flow of exhaust air from the bore 45 into the passages 44 and 38, by adjusting the valve stem 67 outwardly or inwardly, as desired, by means of a suitable tool inserted into a cross slot 69 formed in the outer end of the valve stem 67. The valve stem 67 is locked in a desired adjusted position by means of a suitable lock nut 70. It will be seen that the flow of exhaust air from the exhaust chamber 46, and up through the bore 45 into the passages 44, 38 and 37, and out the exhaust port 36 may be controlled by controlling the position of the flow control valve element 64, relative to the upper end of the bore 45.

Figure 7:
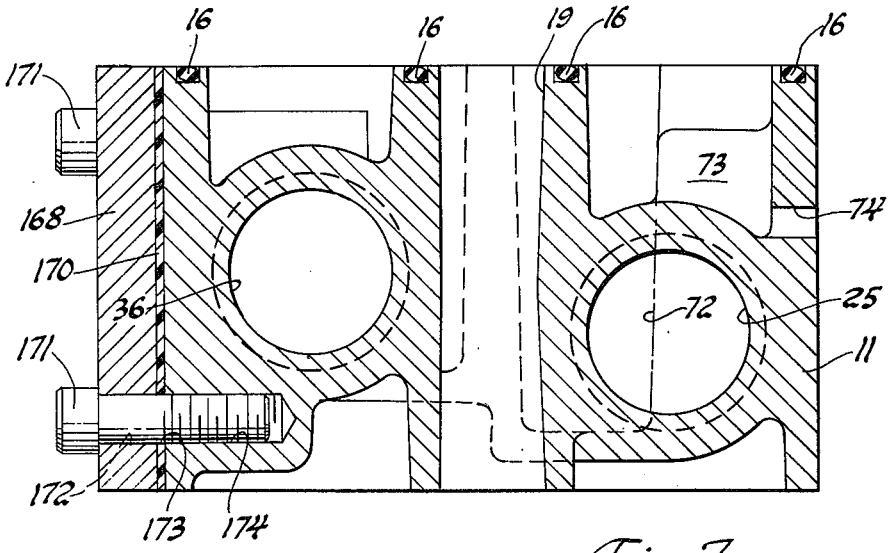
FIG. 7 is an elevation section view of the valve body structure illustrated in FIG. 5, taken along the line 7—7 thereof, and looking in the direction of the arrows.
Figure 14:
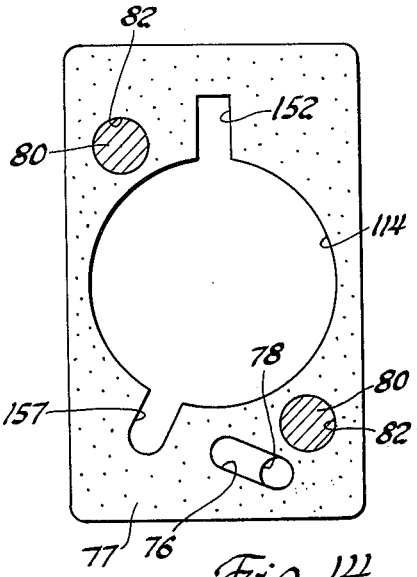
FIG. 14 is an elevation plan view of the pilot adaptor gasket illustrated in FIG. 3, taken along the line 14—14 thereof, and looking in the direction of the arrows.
Figure 17:
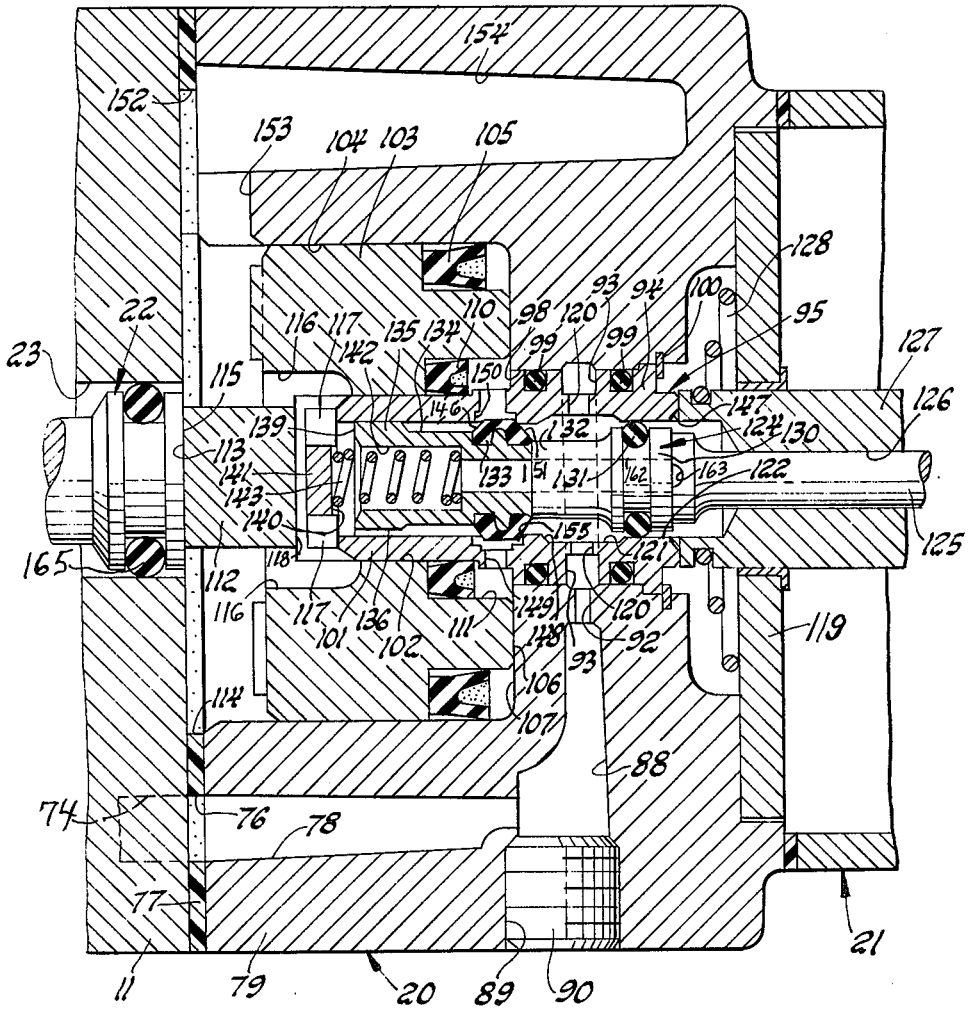
FIG. 17 is a fragmentary view of the right end of the valve structure shown in FIG. 3, and showing the pilot valve structure in an enlarged scale.

As best seen in FIGS. 5 and 7, a vertically extended passage 72 connects the inlet port 25 with a transverse passage 73 which is connected to a transverse passage 74 that extends to the exterior of the valve body 11 and connects to a slot 76 formed through the gasket 77, which is positioned between the valve body 11 and the pilot valve adaptor 20 (FIGS. 14 and 17). As shown in FIG. 17, the slot 76 through the gasket 77 communicates with the outer end of a passage 78 in the pilot valve adaptor body 79. The passage 78 communicates at its inner end with a transverse passage 88 for conducting pilot air to the pilot valve, as described more fully hereinafter. The last described set of passageways between the pressurized air inlet port 25, comprising the passages 72, 73, 74, 76, 78 and 88, provides an internal source of pilot air for operating the pilot valve. The passage 88 is enclosed at the outer end thereof by a suitable plug 90, which is threadably mounted in the outer threaded end 89 of the passage 88. For an external source of pilot air, the adaptor 79 is rotated 180° to block the internal supply, and plug 90 is removed to connect the passage 88 to an external source of pilot air.

Figure 4:
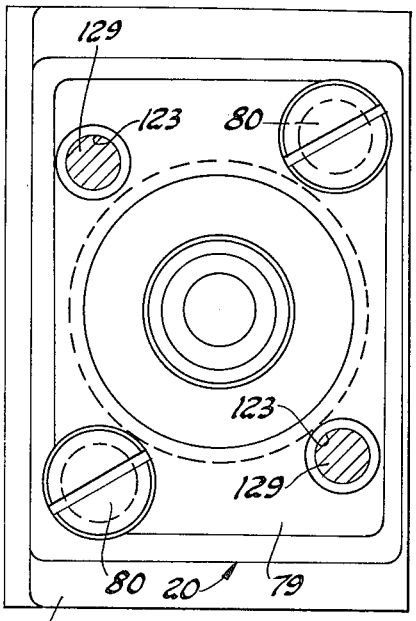
FIG. 4 is an elevation view of the valve structure illustrated in FIG. 3, taken along the line 4—4 thereof, and looking in the direction of the arrows.
Figure 6:
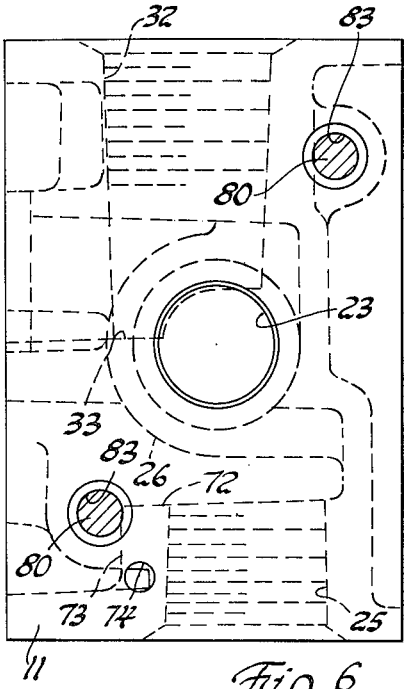
FIG. 6 is a right side elevation view of the valve body structure in FIG. 5, taken along the line 6—6 thereof, and looking in the direction of the arrows.

As shown in FIGS. 4, 6 and 14, the pilot valve adaptor body 79 is releasably secured to the valve body 11 by a pair of suitable machine screws 80, which extend through bores 81 in the adaptor body 79 (FIG. 13), and into threaded engagement with threaded holes 83 in the valve body 11.

As shown in FIG. 17, the pilot air inlet passage 88 communicates at its inner end with a reduced diameter inlet bore or passage 92, which in turn communicates at its inner end with an annular groove 93 that is formed around the enlarged cylindrical body portion 94 of a pilot valve element retainer, generally indicated by the numeral 95. The pilot valve element retainer 95 has its outer enlarged cylindrical body portion 94 slidably mounted in an axial bore 98 which extends inwardly from the outer end of the pilot valve adaptor body 79. A pair of suitable O-ring seals 99 are mounted in grooves around the outer periphery of the retainer body outer end portion 94, and they sealingly engage the bore 98 on either side of the annular groove 93. The pilot valve element retainer 95 is releasably secured in the bore 98 by a suitable, releasable retainer ring 100.

The numeral 101 in FIG. 17 designates the reduced diameter inner end of the body of the pilot valve element retainer 95, and it is slidably mounted in a reduced diameter axial bore 102 in a pilot valve piston 103. The pilot valve piston 103 is cylindrical, and it is slidably mounted in an enlarged cylinder or chamber 104 which extends inwardly from the left end or inner end of the pilot valve adaptor body 79, and which communicates with the valve spool bore 23 through an opening 114 in the gasket 77. The pilot valve piston 103 is provided with an annular outer seal 105, which is seated in a groove formed around the periphery of the piston 103 adjacent the outer end thereof, as shown in FIG. 17. The outer or right end of the pilot valve piston 103 is indicated by the numeral 106, and it normally abuts the inner end transverse face 107 of the pilot valve piston cylinder or chamber 104.

The numeral 110 in FIG. 17 designates an annular inner seal which is seated in a bore 111 formed around the periphery of the piston axial bore 102 adjacent the rear end of the pilot valve piston 103. The seal 110 sealingly engages the outer periphery of the pilot valve element retainer body inner end portion 101. The pilot valve piston 103 is provided on its front end with an axial shaft 112 which has an outer end 113 that engages the right end 115 of the main valve spool 22.

As shown in FIG. 17, the axial bore 102 in the pilot valve piston 103 extends to the point 118 where it communicates with a pair of longitudinal bores 116, on opposite sides of the piston shaft 112, that extend inwardly from the front or outer face of the pilot valve piston 103, and communicate at their front ends with the piston cylinder 104.

As shown in FIG. 17, the exterior annular groove 93 in the pilot valve element retainer 95 communicates through a plurality of inwardly extended radial bores 120 with an annular recess or chamber 121 which is formed in the axial bore 122 of the pilot valve element retainer 95. A pilot valve element, generally indicated by the numeral 124, is slidably mounted within the bore 122 in the pilot valve element retainer 95. The outer end of the pilot valve element 124 is engaged by the armature pusher rod 125 of the conventional solenoid 21. The armature pusher rod 125 is slidably mounted through a bore 126 in the solenoid pole piece 127. One end of a coil spring 128 is retained in a groove around the outer end of the pole piece 127, and the other end is seated against the outer face of a solenoid flux plate 119. The spring 128 functions to bias the pole piece 127 against the pilot valve element retainer 95 to provide a floating pole piece that functions as the pole piece described in U.S. Pat. No. 3,538,954.

Figure 16:
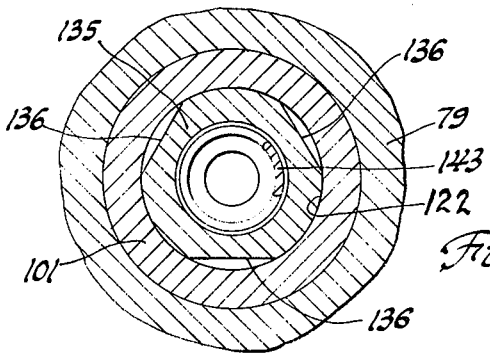
FIG. 16 is an enlarged, elevation section view of the pilot valve structure illustrated in FIG. 3, taken along the line 16—16 thereof, and looking in the direction of the arrows.

As shown in FIG. 17, the pilot valve element 124 includes an outer end cylindrical valve land 130 which is provided with an annular groove in which is seated a suitable O-ring 131 that sealingly engages the retainer bore 122. The pilot valve element 124 further includes an integral reduced diameter central stem 132 on one end of which is mounted an annular molded valve member 133. The front end of the annular valve member 133 is seated against the shoulder formed by an enlarged diameter pilot valve element portion 134 which is integral with a further enlarged diameter inner end portion 135 that is slidably mounted in the retainer bore 122. As shown in FIGS. 16 and 17, the space or passage in the retainer bore 122, between the pilot valve element reduced diameter portion 134 and the bore 122, communicates with the retainer bore 122 beyond the inner end portion 135 of the pilot valve element 124, by means of three flattened portions 136 which are formed around the periphery of the pilot valve element enlarged inner end portion 135. As shown in FIG. 17, the inner end of the bore 122 in the retainer 95 communicates through a pair of transverse passages 117 with the two axial bores 116 in the piston 103.

The pilot valve element 124 is normally biased to the right, to the position shown in FIG. 17, by a coil spring 143, which is operatively mounted in an axial bore 142 that is formed in the inner end of the pilot valve spool or element 124. The inner end of the spring 143 abuts the inner end wall of the bore 142, and the outer end of the spring 143 abuts the inner face 140 of a transverse wall 141 on the inner end of the pilot valve element retainer 95.

The pilot valve spool or element 124 is forced into the one-piece retainer 95, and it cannot be removed without destroying the spool 124. The lead angle 146 on the annular valve spool member 133 is approximately 30° off the vertical axis, as viewed in FIG. 17. The chamfer angle 147 at the entrance end of the retainer bore 122 is approximately 30° off the horizontal axis, as viewed in FIG. 17. The angle 148 at the point where the annular chamber 121 terminates at the bore 122 is also 30° off the vertical axis, as viewed in FIG. 17. The last described angled structures permit the pilot valve element or spool 124 to be easily forced into the retainer 124, but not be removed in the opposite direction without destroying the pilot valve element 124. The reverse or trailing angled face 151 on the annular valve spool member 133 is formed at about a 30° angle off the vertical axis, as viewed in FIG. 17, and it is normally biased by the spring 143 against the valve seat 155 which is formed by the junction of the retainer bore 122 within an annular groove 150, formed around the bore 122. The annular groove 150 communicates through a plurality of radial bores 149 with the bore 111 in the piston 103.

Figure 12:
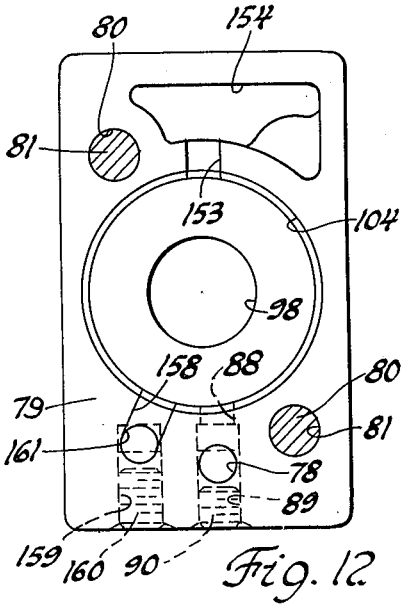
FIG. 12 is an outer end elevation view of the pilot valve adaptor housing employed in the invention, taken along the line 12—12 of FIG. 3, and looking in the direction of the arrows.
Figure 13:
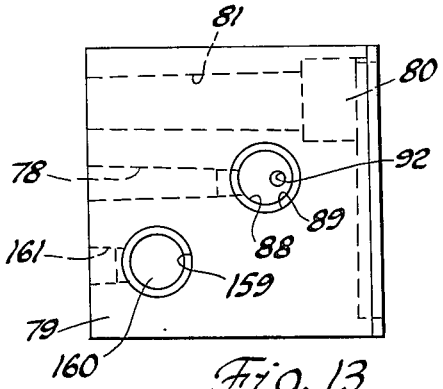
FIG. 13 is a side elevation view of the pilot valve adaptor housing illustrated in FIG. 3, taken along the line 13—13 thereof, and looking in the direction of the arrows.

It will be seen that pilot air entering the pilot adaptor housing body 79, through the passages 78 and 88, and thence through the bore 92, groove 93, bores 120 and chamber 121 is blocked from engaging the piston 103 because of the annular valve spool member 133 being seated on the valve seat 155, by action of the coil spring 143. When the pilot valve spool 124 is in the position shown in FIG. 17, the main spool valve 22 is biased to the right, as shown in FIG. 3, by means of a coil spring 167 so as to move the pilot valve piston 103 to the initial position shown in FIGS. 3 and 17. When the annular valve spool element 133 on the pilot valve spool 124 is seated against the valve seat 155, any pilot air behind the piston 103 is exhausted from behind the piston 103 and out through the bore 111, the bores 149, and the annular groove 150 into the bore 122. The air is then exhausted past the flat portions 136 on the pilot valve spool 124 and out through the passages 117 and bores 116 and into the piston chamber 104 in front of the piston 103, and thence laterally outward through the passage 153 in the pilot housing 79, and the passage 152 in the gasket 77, into the chamber 154. As shown in FIG. 9, the pilot air may be optionally exhausted through an internal passage 145 in the valve body 11 into the exhaust passage 38 that is connected to the exhaust port 36. As shown in FIGS. 12 and 13, the pilot air may also be exhausted down through the passage 158 in the pilot valve adaptor housing 79 and the passage 157 (FIG. 14), in the gasket 77 and into a passage 161 and out through a threaded bore 159. The threaded bore 159 may be operatively connected to a conduit for conducting the pilot air to a remote point, or it may be enclosed by a suitable plug 160 to permit use of the aforementioned optional internal pilot air exhaust system.

As shown in FIG. 17, the numeral 163 is a transverse passage through the outer end of the solenoid armature pusher rod 125, and it communicates with a longitudinal passage 162 which communicates with the bore 142 in the pilot valve spool 124. The passages 162 and 163 vent any pressure that may get into the retainer bore 122 in the enclosed space to the right of the O-ring 131, as viewed in FIG. 17.

As shown in FIG. 3, the main valve spool 22 is provided with a suitable O-ring seal 165 at each end thereof, which sealingly engage the valve spool bore 23. The main valve spool 22 is normally biased to the right by the coil spring 167, and it is moved to the left when the solenoid 21 is operated to allow pilot air to move the pilot piston 103 to the left, as viewed in FIG. 3. The return coil spring 167 has one end mounted in an axial bore 166 which extends inwardly from the left end of the valve spool 22. The outer end of the coil spring 167 abuts an end cover plate 168.

A suitable gasket 170 is mounted between the cover plate 168 and the valve body 11. The cover plate 168 is releasably secured in position by means of a plurality of machine screws 171 which pass through bores 172 in the plate 168, bores 173 in the gasket 170 and into threaded bores 174 in the valve body 11 (FIG. 7).

Figure 15:
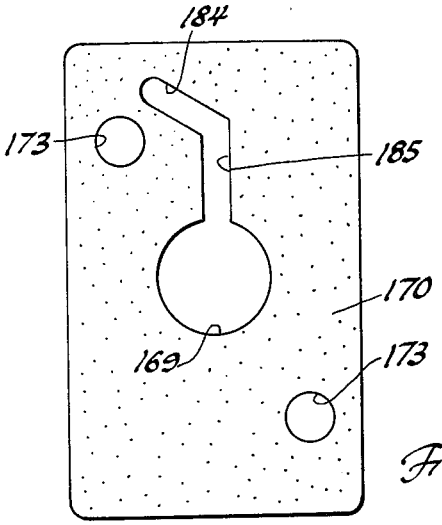
FIG. 15 is an elevation view of the return spring retainer cover gasket illustrated in FIG. 3, taken along the line 15—15 thereof, and looking in the direction of the arrows.

The return spring 167 in FIG. 3 is provided with an air assist return, by inlet air provided through the following passages. As shown in FIG. 3, the end cover gasket 170 is provided with a central opening 169 through which the outer end of the spring 167 is disposed. An upwardly extending passage 185 is formed in the gasket 170 (FIG. 15), and it communicates at its lower end with the central opening 169. As shown in FIG. 15, the vertical passage 185 communicates with an upwardly and laterally extended connecting passage 184. As shown in FIG. 5, the gasket passage 184 communicates with an inwardly extended passage 183 in the valve body 11, which in turn communicates with a chamber 182 in the upper end of the valve body 11. The chamber 182 communicates with a vertically extended passage 180 in the valve body 11, which communicates at its lower end with the inlet chamber 27 that is supplied with inlet pressurized air from the inlet port 25. The upper end of the vertical passage 180 is enclosed by a mating passage 181 in the cover 12, as shown in FIG. 8. It will be seen, that pressurized inlet air is conducted through the last described passages to the left end of the main valve spool bore 23 and into engagement with the left end of the main valve spool 22, as shown in FIG. 3, for assisting the return spring 167 in returning the main valve spool 22 to the initial position shown in FIG. 3.

In use, the adjustable flow control valves 50 and 51 would be adjusted to provide a desired opening between the bores 40 and 45, and the valve elements 54 and 64, to provide a desired speed of operation of an air cylinder to be controlled. With the main valve spool 22 in the position shown in FIG. 3, the inlet passage 25 supplies air under pressure to the annular supply chamber 27. With the main valve spool 23 in the initial position shown in FIG. 3, the pressurized air flows from the chamber 27 and through the bore 23 into the cylinder chamber 31 and out through the cylinder port 30. Simultaneously, air from the other end of the air cylinder would be exhausted through the cylinder port 32, the cylinder chamber 33, the bore 23 and the exhaust chamber 46. The exhausting air would flow through the bore 46, the passage 44 and into the passage 38 and thence downwardly through the passage 37 and out the exhaust port 36. During the last described operation, it will be seen that the annular valve element 188 on the main valve spool 22 is moved into the inlet chamber 27 so as to permit flow through the bore 23 into the cylinder chamber 31. Simultaneously, the main spool annular valve element 190 is blocking flow from the cylinder chamber 31 into the exhaust chamber 41. At the same time, the annular main valve spool element 189 is blocking flow between the inlet chamber 27 and the valve chamber 33, and the main valve spool annular element 191 is moved into the exhaust chamber 46 to unblock flow between the cylinder chamber 33 through the bore 23 and into the exhaust chamber 46.

When the solenoid 21 is energized in the usual manner, the armature pusher member 125 functions to move the pilot valve element 124 inwardly, or to the left as viewed in FIGS. 3 and 17, against the pressure of the return spring 143. The last mentioned movement of the pilot valve element 124 moves the annular valve angled face 151 off of the valve seat 155 so as to allow flow of pilot air from the chamber 121 and through the annular goove 150 and the bores 149 into the bore 111 in the piston 103. Simultaneously, the leading angled face 146 on the valve element 133 engages the other meeting point of the groove 150 with the bore 122 to close communication of the bore 111 in the piston 103 with the aforedescribed pilot air exhaust flow system. The pilot air entering the bore 111 in the piston 103 will commence movement of the piston 103 to the left, as viewed in FIGS. 3 and 17, and air will then get behind the entire piston 103 and continue the leftward movement so as to move the main valve spool 23 to a position to reverse the aforedescribed flow of inlet pressure and exhaust air from the valve 10. When the solenoid 21 is de-energized, the pilot valve return spring 143 will move the pilot valve element 124 back to the initial position shown in FIG. 17 to cut off the pilot air to the pilot valve element and to permit exhaustion of the pilot air from behind the piston 103 out through the pilot air exhaust system, as described hereinbefore. The exhausting pilot air provides an air assist on the pilot valve element 124, assisting spring 143 in returning valve element 124. It has been found that the cartridge type valve employed in the invention, which comprises the one-piece pilot valve element retainer 95 and non-removable pilot valve element 124, may be quickly and easily removed as a unit for repair purposes, from the top end of the housing 79 (right end as viewed in FIG. 3), and replaced in a minimum of downtime. It has also been found that it is desirable to maintain a ratio of approximately three to one, of the summation of the total exhaust areas across the flat portions 136 on the pilot valve element 124 to the inlet area of the inlet bore 92. It will be understood that the valve 10 may be provided with a second solenoid and cartridge type pilot valve in lieu of the return spring 167.

INDUSTRIAL APPLICABILITY

The four-way valve with integral flow controls, a common exhaust, and a cartridge type pilot valve is adapted for use in industrial air use applications. The valve of the present invention may be used for connection to both ends of an air cylinder for controlling the operation of the same in both directions. The air cylinder may be employed in various types of industrial machines. The valve may be operated by an internal pilot air supply or a remote pilot air supply. The valve spool may be a two-position, single or double solenoid type, or a three-position, closed center or open center type.

I claim:

1. A four-way air valve which includes a valve body with a pressurized air supply chamber, a pair of cylinder chambers and a pair of exhaust chambers, and a main valve spool axially movable between two operative positions in a valve spool bore in the valve body to control flow of pressurized air from the air supply chamber to a selected one of said cylinder chambers while simultaneously controlling the exhaust from the other cylinder chamber to a selected one of said exhaust chambers, a top cover releasably mounted on said valve body, and means for moving the main valve spool between the two operative positions, characterized in that:

(a) said air supply chamber is disposed centrally along the valve spool bore, with the cylinder chambers disposed along the valve spool bore on opposite sides of said air supply chamber and adjacent thereto, and with the exhaust chambers disposed along the valve spool bore with one of the cylinder chambers on a side thereof opposite to the side adjacent to the air supply chamber;

(b) the valve body is provided with a pressurized air inlet port which is connected by inlet passage means in the valve body to the air supply chamber;

(c) the valve body is provided with two cylinder ports which are each connected by separate cylinder passage means to one of the cylinder chambers;

(d) the valve body is provided with a single exhaust port which is connected by an exhaust passage means to a common exhaust passageway in the valve body, and each of the exhaust chambers is connected to the common exhaust passageway by a separate passage;

(e) said means for moving the main valve spool to at least one operative position comprises a cartridge type solenoid operated pilot air valve which includes:

1. a pilot air valve body, and means for releasably securing one end of the pilot air valve body to the four-way valve body;

2. a pilot valve piston movably mounted in a cylinder in said pilot air valve body, and having a front end and a rear end, and provided with an axial shaft which extends axially forward from the pilot valve piston front end and engages one end of the main valve spool, and having an axial bore extended inwardly from the rear end thereof and terminating adjacent the pilot valve piston front end;

3. a pilot valve element retainer releasably seated in the pilot air valve body and having an inner end and an outer end, and with the inner end slidably mounted in the axial bore in said pilot valve piston, and said retainer having an axial bore that extends inwardly from the outer end thereof and terminates in a transverse wall;

4. a pilot valve element movably mounted in the axial bore in the pilot valve element retainer and movable, by a spring mounted in the axial bore in said retainer, to a first operative position to block flow of pilot air to the pilot valve piston cylinder against the rear end of the pilot valve piston and allow exhaust of pilot air from the rear end of the pilot valve piston in said cylinder through exhaust passageway means formed along the outer periphery of the pilot valve element and through the axial bore in said retainer and passages through the front end of said piston and through the piston chamber to an external exhaust passage, and movable by a solenoid armature pusher member to a second operative position to allow flow of pilot air to the rear end of the pilot valve piston, to move the piston and the axial shaft thereon, which in turn moves the main valve spool.

2. A four-way air valve, as defined in claim 1, characterized in that:

(a) the pilot valve element has a lead angle thereon which coacts with a chamfer angle at the entrance end of the retainer bore to allow the pilot valve element to be forced into the retainer bore but not removed, whereby the pilot valve element is non-removably mounted in the pilot valve element retainer.

3. A four-way air valve, as defined in claim 2, characterized in that:

(a) the pilot valve element retainer is of a one-piece construction.

4. A four-way air valve, as defined in claim 3, characterized in that:

(a) the pilot valve element retainer and pilot valve element are removable as a combined unit from the end of pilot air valve body opposite to the end of the pilot air valve body which is attached to the four-way air valve body.

5. A four-way air valve, as defined in claim 2, characterized in that:

(a) the ratio of area of the pilot air valve exhaust passage cross sectional area of the pilot valve inlet passage cross sectional area is about three to one.

6. A cartridge type pilot air valve for operating the main valve spool in an air valve, characterized in that it includes:

(a) a pilot air valve body;

(b) a pilot valve piston movably mounted in a cylinder in said pilot air valve body, and having a front end and a rear end, and provided with an axial shaft which extends axially forward from the pilot valve piston front end and engages one end of the main valve spool, and having an axial bore extended inwardly from the rear end thereof and terminating adjacent the pilot valve piston front end;

(c) a pilot valve element retainer releasably seated in the pilot air valve body and having an inner end and an outer end, and with the inner end slidably mounted in the axial bore in said pilot valve piston, and said retainer having an axial bore that extends inwardly from the outer end thereof and terminates in a transverse wall;

(d) a pilot valve element movable mounted in the axial bore in the pilot valve element retainer and movable, by a spring mounted in the axial bore in said retainer, to a first operative position to block flow of pilot air to the pilot valve piston cylinder against the rear end of the pilot valve piston and allow exhaust of pilot air from the rear end of the pilot valve piston in said cylinder through exhaust passageway means formed along the outer periphery of the pilot valve element and through the axial bore in said retainer and passages through the front end of said piston and through the piston chamber to an external exhaust passage, and movable by a solenoid armature pusher member to a second operative position to allow flow of pilot air to the rear end of the pilot valve piston, to move the piston and the axial shaft thereon, which in turn moves the main valve spool.

7. A cartridge type pilot air valve, as defined in claim 6, characterized in that:

(a) the pilot valve element has a lead angle thereon which coacts with a chamfer angle at the entrance end of the retainer bore to allow the pilot valve element to be forced into the retainer bore but not removed, whereby the pilot valve element is non-removably mounted in the pilot valve element retainer.

8. A cartridge type pilot air valve, as defined in claim 7, characterized in that:

(a) the ratio of area of the pilot air valve exhaust passage cross sectional area to the pilot valve inlet passage cross sectional area is about three to one.

9. A cartridge type air valve, as defined in claim 7, characterized in that:

(a) the pilot valve element retainer is of a one-piece construction.

10. A cartridge type air valve, as defined in claim 9, characterized in that:

(a) the pilot valve element retainer and pilot valve element are removable as a combined unit from the end of the pilot air valve body opposite to the end of the pilot air valve body which is attachable to an air valve.

* * * * *